US006789306B1

(12) United States Patent
Konig

(10) Patent No.: US 6,789,306 B1
(45) Date of Patent: Sep. 14, 2004

(54) METHOD FOR PRODUCING A FLAT COMMUTATOR AND A COMMUTATOR PRODUCED ACCORDING TO THIS METHOD

(75) Inventor: Eckhard Konig, Ehningen (DE)

(73) Assignee: Kautt & Bux GmbH (DE)

( * ) Notice: Subject to any disclaimer, the term of this patent is extended or adjusted under 35 U.S.C. 154(b) by 0 days.

(21) Appl. No.: 09/980,854

(22) PCT Filed: Jun. 9, 2000

(86) PCT No.: PCT/EP00/05333

§ 371 (c)(1),
(2), (4) Date: Dec. 4, 2001

(87) PCT Pub. No.: WO00/77889

PCT Pub. Date: Dec. 21, 2000

(30) Foreign Application Priority Data

Jun. 12, 1999 (DE) ..... 199 26 900

(51) Int. Cl.[7] ..... H01R 43/06; H01R 43/10

(52) U.S. Cl. ..... 29/597; 29/598; 29/460; 310/234; 310/235; 310/237

(58) Field of Search ..... 29/597, 598, 460; 310/234, 235, 237

(56) References Cited

U.S. PATENT DOCUMENTS 5,157,299 A * 10/1992 Gerlach ..... 310/237
5,175,463 A * 12/1992 Farago et al. ..... 310/237
5,925,962 A * 7/1999 Kobman et al. ..... 310/237
6,080,497 A * 6/2000 Carey et al. ..... 428/647

FOREIGN PATENT DOCUMENTS

| | | |
|---|---|---|
| FR | 2330169 | 5/1977 |
| JP | 58075440 | 5/1983 |
| WO | 9703486 | 1/1997 |

* cited by examiner

*Primary Examiner*—A. Dexter Tugbang
*Assistant Examiner*—Tim Phan
(74) *Attorney, Agent, or Firm*—Roylance, Abrams, Berdo & Goodman, L.L.P.

(57) ABSTRACT

A method for producing a flat commutator includes forming a metallic supporting body with segment supporting parts and forming a hub of an electrically insulating material. The supporting body is connected in an electrically conductive and mechanically fixed manner to an annular disc resistant in a reaction-promoting environment. The supporting body is divided into segment support parts. The annular disc is divided into annular segments. The surfaces of the metallic segment supporting parts which are bare as a result of the division of the supporting body are coated with a coating that is resistant to the environment. The coating is carried out by currentless deposition. The commutator produced according to this method has the hub adjacent to the supporting body in the vicinity of the division.

8 Claims, 4 Drawing Sheets

METHOD FOR PRODUCING A FLAT COMMUTATOR AND A COMMUTATOR PRODUCED ACCORDING TO THIS METHOD

CROSS REFERENCE TO RELATED DOCUMENT

This application is the U.S. national phase of PCT/EP00/05333, filed Jun. 19, 2000, which claims benefit German Application No. 199 26 900.9, filed Jun. 12, 1999.

FIELD OF THE INVENTION

The present invention relates to a process for producing a flat commutator and a commutator produced using this process. These commutators can be used especially in electric motors to drive a fuel pump which pumps fuels obtained from renewable raw materials.

BACKGROUND OF THE INVENTION

In the production process disclosed in WO 97/03486, a metallic, pot-shaped carrier body forms segment support parts and is shaped from a copper plate. The copper plate has been segmented beforehand by grooves and is extruded with a hub formed from an electrically insulating molding compound. The carrier body, on its side forming the contact surface for the carbon-containing annular disk, is then removed to such an extent that the segment support parts are electrically separated from one another by the grooves filled with the molding compound. Then, the annular disk is applied and subsequently, according to the segmentation of the carrier body, divided into segments, the separating slots projecting into the area of the grooves which is filled with the molding compound.

Since in using the known process the carrier body is segmented before the annular disk is applied, the process requires additional steps to make grooves in the carrier body and remove the carrier body into the area of the grooves. Moreover, the dividing must take place precisely in the area of the grooves to ensure resistance to a reactive environment.

DE 36 25 959 C2 shows a drum commutator and a process for its production, in which either on a cylinder produced by curling a base plate of a parent or base metal, copper, or on a hollow cylindrical tube piece, protective parts are applied by plating with a copper-nickel or silver-nickel alloy, at least on the surfaces which come into contact with the brushes. Furthermore, the parent metal of the commutator segments is provided on its surface with tin plating by electrolytic plating (column 13, lines 16 and 17) to prevent the copper body from being exposed to a fuel, such as gasohol, to prevent decomposition of the fuel. A mixture of unleaded gasoline and 10 to 15% ethyl alcohol is defined as gasohol in the patent.

DE 44 35 884 C2 shows a commutator for use in fuel pumps, with bars located around the periphery of the commutator and in sliding contact with a brush arrangement, of a wear-resistant copper-magnesium alloy. The magnesium portion of the bars is between 0.05 and 2.00 percent by mass.

In contrast to this invention, JP 58 075440 A does not disclose a flat commutator, but a drum commutator. Furthermore, this document is directed at the prevention of fuel oxidation ("to prevent the oxidation of gasoline"). To this end, a plate (sheet 8) resistant to fuel is connected with the not yet burnished copper plate forming the carrier body.

FR2 330 169 A also discloses a drum commutator (cf. FIGS. 1 to 3) and hence a nongeneric subject. The layer with reference numbers 11*a* and 11*b* depicted in FIG. 5 of this document is a layer produced by oxidation.

U.S. Pat. No. 5,175,463 discloses a flat commutator with segment support parts separated by radial slots. A compound with low melting point of different metals is used in the connection of the carbon-containing annular disk with the metallic segment support parts.

DE 29 03 029 C2 represents the proximate state of the art and discloses among others a process for producing a flat commutator in which a copper plate with a disk-shaped sheet of silver or silver alloy invulnerable to gasoline is applied. The copper plate is sloted at regular intervals. The denuded copper parts of the commutator bars are covered with a galvanically applied electroplated layer of silver or tin.

SUMMARY OF THE INVENTION

Objects of the present invention are to provide a process for producing a flat commutator which eliminates the disadvantages of the prior art, which in particular is more economical, and which still ensures sufficient resistance of the finished commutator in a reactive environment. In addition, the coating will be relatively thick, especially in undercuts and/or grooves which may be present as a result of dividing the carrier body, and will be as uniform as possible. In any case, it will be possible to apply the coating to form a cohesive layer. The present invention permits use of electric motors for driving a pump for fuels obtained from renewable raw materials.

The surfaces of the metallic segment support parts, which are exposed by dividing, are covered with a coating which is resistant to a reactive or aggressive environment. The resistance relates especially to protection of the carrier body and/or the segment support parts and the connection to the annular disk against breakdown, relates to electrical conductivity with respect to the contact resistance between the commutator contact surface formed by the annular disk and the pertinent segment support part or between it and the commutator brush, and relates to the adhesion of the coating on the metallic segment support part. Also, insulation must be ensured between the segment support parts. The segment support parts preferably and essentially consist of copper and have high electrical conductivity and ductility. The carrier body is produced, for example, from a punched-out copper plate which is then formed into a pot and is extruded with a molding mass forming the hub. The carbon-containing annular disk in particular is resistant in a reactive environment, for example in a hydrocarbon-containing liquid. The annular disk and/or the carrier body is/are divided preferably by abrasive cutting, sawing or laser working.

The process steps of forming the grooves and removing the carrier body are eliminated by the carrier body being divided into segment support parts after joining to the annular disk.

Production is further simplified by the annular disk and the carrier body being divided in one step. Alternatively, it is possible in a first step to divide the carrier body, provided with the hub and formed into a pot, into segment support parts by first slots. Then, the annular disk is applied. Finally, the annular disk is divided by two slots into annular segments, the second slots preferably being smaller than the first slots and being located within the first slots. The coating of the surfaces of the segment support parts exposed by dividing the carrier body can be done before or after the application of the annular disk. To the extent the coating takes place before applying the annular disk, the applied layer can be used at the same time as a joining layer to the annular disk.

Because coating takes place by deposition, the metallic carrier body can be coated with any material. Both chemical and also physical and mixed deposition processes can be used, for example deposition from the gaseous phase (Chemical Vapor Deposition, CVD), optionally plasma- or laser-supported, cathode beam atomization (sputtering), vapor deposition, etc. Vossen, Kern (publisher): Thin Film Processes I and II, 1991, surveys possible deposition methods.

Because deposition takes place from a solution or suspension, a large number of commutator elements can be coated in one step, and thus, economically and with good coverage and layer quality. The layer material is in a preferably an ionic solution or suspension and can be deposited electrolytically (galvanically) or currentlessly on the segment support parts.

Because deposition takes place currentlessly from the solution or suspension, i.e. without applying an external voltage, coverage of the elements even on inaccessible locations, for example in the dividing slots formed by division, is good. The temperature and concentration of the solution or suspension are chosen such that complete coverage with sufficient thickness is ensured in as short a time as possible.

Because coating takes place selectively only on surfaces of the segment support parts, the annular disk and especially the hub are not coated, preventing the detachment of the layer from these locations, for example due to poor adhesion, and the associated problems in later operation of the commutator. The selectivity of deposition can be adjusted by the corresponding choice of the process parameters during deposition, for example the deposition temperature, concentration of the solution or suspension, deposition duration, etc., depending on the material to be deposited and/or the carrier body to be coated.

Because coating takes place with tin, silver or chromium, good coverage and adhesion as well as sufficient resistance especially to fuels obtained from renewable raw materials is also ensured with economical materials. Tin in particular offers good contact properties, and is also advantageous for joining the winding ends to the segment support parts.

Because the layer thickness is between 0.1 and 10 $\mu$m, especially between 1 and 3 $\mu$m, reliable coating and good adhesion as well as sufficient resistance are guaranteed. These layer thicknesses arise especially in currentless deposition from a solution or suspension after comparatively short deposition intervals and ensure pore-free coverage of the carrier body.

In a commutator produced using the process of the present invention, the hub in the area of the division, especially on the side of the segment support parts facing away from the commutator contact surface and/or the surfaces adjoining the surfaces exposed by the division of the carrier body, also adjoins the carrier body. Thus, reliable coverage of the metallic carrier body is also ensured in this area. This coverage prevents scouring of the carrier body and the segment support parts in a reactive atmosphere.

Because the hub forms a complete cover of the cylindrical boundary surface of the central hole of the carrier body, the cylindrical inside of the carrier body is also covered relative to the reactive atmosphere. Also, the resistance of the commutator is further increased.

Because the coating is resistant to the fuel to be pumped, commutators produced using the process of the present invention can also be used in fuel pumps. Especially, tin as the coating material has proven resistant to fuels obtained from renewable raw materials, for example alcohol-based fuels or diesel fuels obtained from rapeseed oil.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
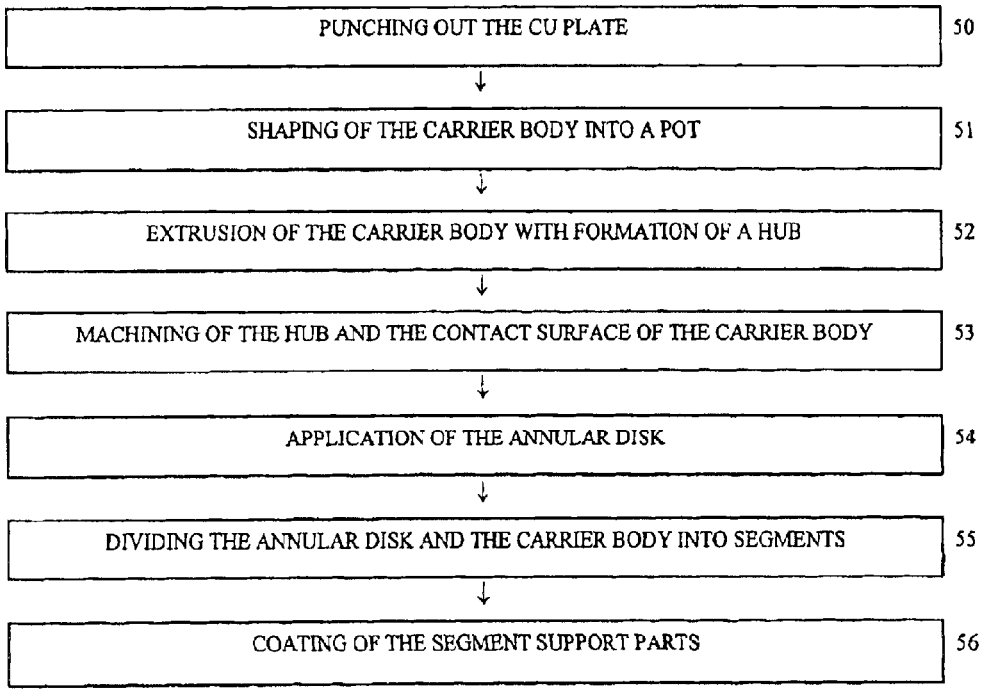
FIG. 1 is a block diagram of a production process according to a first embodiment of the present invention.

FIG. 1 shows a first embodiment of the production process of the present invention. A copper plate is punched out of a copper sheet 50 and a pot-shaped carrier body 51 is then formed from it. The bottom surface of the pot forms the contact surface for the annular disk to be applied. The bottom surface is not presegmented. However, the cylindrical jacket surface of the pot has already been segmented by punching-out. Likewise, hook elements for attaching the coil windings and anchor elements which fit into the hub are made by punching-out. The hub is formed by extrusion 52 of the pot-shaped carrier body by means of an electrically insulating molding compound which is temperature-resistant according to the respective requirements. Optionally the hub and the contact surface of the carrier body can be worked 53, with respect to the hub. Especially, precision machining of the hub hole which holds the shaft of the rotor is carried out. With respect to the contact surface of the carrier body, planarizing and optionally pretreatment take place for subsequent application 54 of the annular disk.

The annular disk preferably contains carbon or consists completely of sintered carbon which has the morphology and grain composition necessary with respect to electrical conductivity, abrasion resistance and resistance. The inside diameter of the annular disk is preferably larger than the diameter of the hole in the hub. Dividing 55 of the annular disk and of the carrier body into segments is done, preferably by a single machining process, for example by abrasive cutting or sawing. The cut slot extends through the annular disk and the bottom of the pot-shaped carrier body, and into the molding compound which follows the carrier body and adjoins it. Division yields the separation of the segments of the commutator in electrical terms, i.e., the electrically conductive connections between the segments are cut through. As before, the segments are mechanically joined securely to one another via the molded-on hub.

Coating 56 of the carrier body takes place with a material resistant to a reactive environment, for example with tin, silver, or chromium in a layer thickness of 0.1 to 10 $\mu$m, preferably 1 to 3 $\mu$m. Here preferably all exposed surfaces of the carrier body are coated, especially the surfaces of the metallic segment support parts exposed by the division of the carrier body. Coating takes place preferably by currentless deposition from a solution or suspension, i.e., without a voltage being applied from the outside between the carrier body to be coated and the solution or suspension. Before actual coating, chemical and/or mechanical cleaning takes place, for example in an ultrasonic bath in order to remove impurities and residues on the surface of the segment support parts and to prepare the surface for coating. The essentially copper-containing segment support parts can then be pretreated in a reducing atmosphere. The actual coating takes place preferably at a temperature which has been elevated compared to the ambient temperature. In the corresponding solutions or suspensions for example with deposition intervals of less than one hour, layer thicknesses between 1 and 3 μm can be achieved. A plurality of commutator elements can be coated in one process. After coating the commutators are rinsed and dried.

Figure 2:
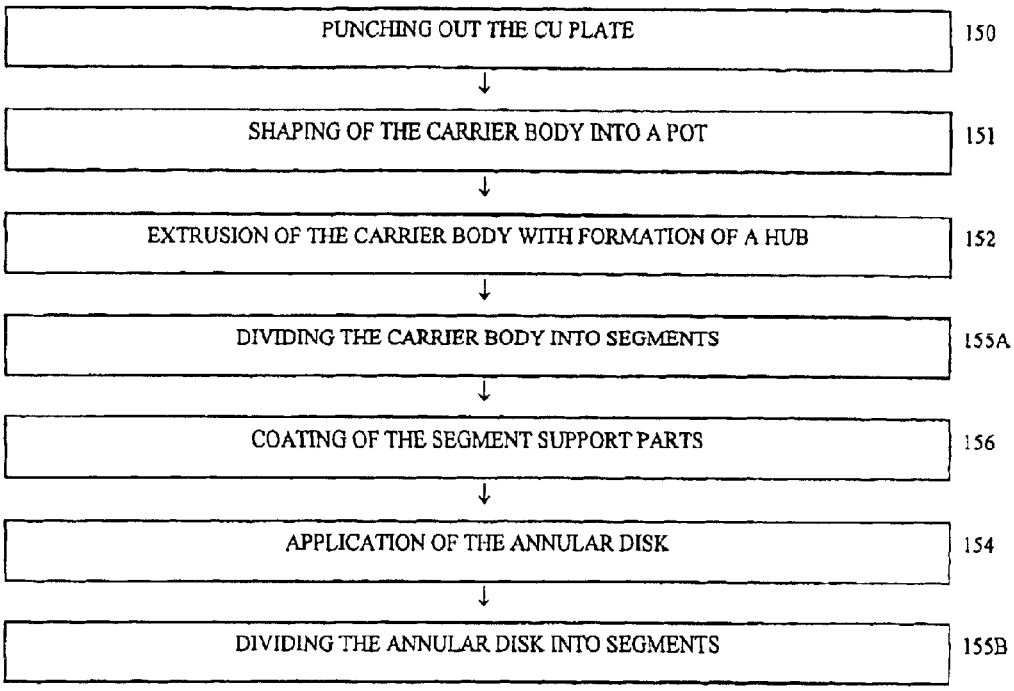
FIG. 2 is a block diagram of a production process according to a second embodiment of the present invention.

FIG. 2 shows a second embodiment of the production process of the present invention. After extrusion 152 of the carrier body with the formation of a hub, the carrier body is divided into segment support parts 155A. Then, as described above, coating 156 of the segment support parts is carried out. Alternatively, coating can also take place galvanically or electrolytically, for example with silver in a layer thickness of roughly 5 μm. The annular disk is then applied 154 and then divided into annular segments 155B. The cut slots in the annular disk are preferably narrower or equally wide compared to the cut slots in the carrier body, in any case located within the annular disk. Alternatively or in addition to coating 156 of the segment support parts immediately after division 155A of the carrier body, the segment support parts can also be coated as described above only after dividing 155B the annular disk into annular segments.

Figure 3:
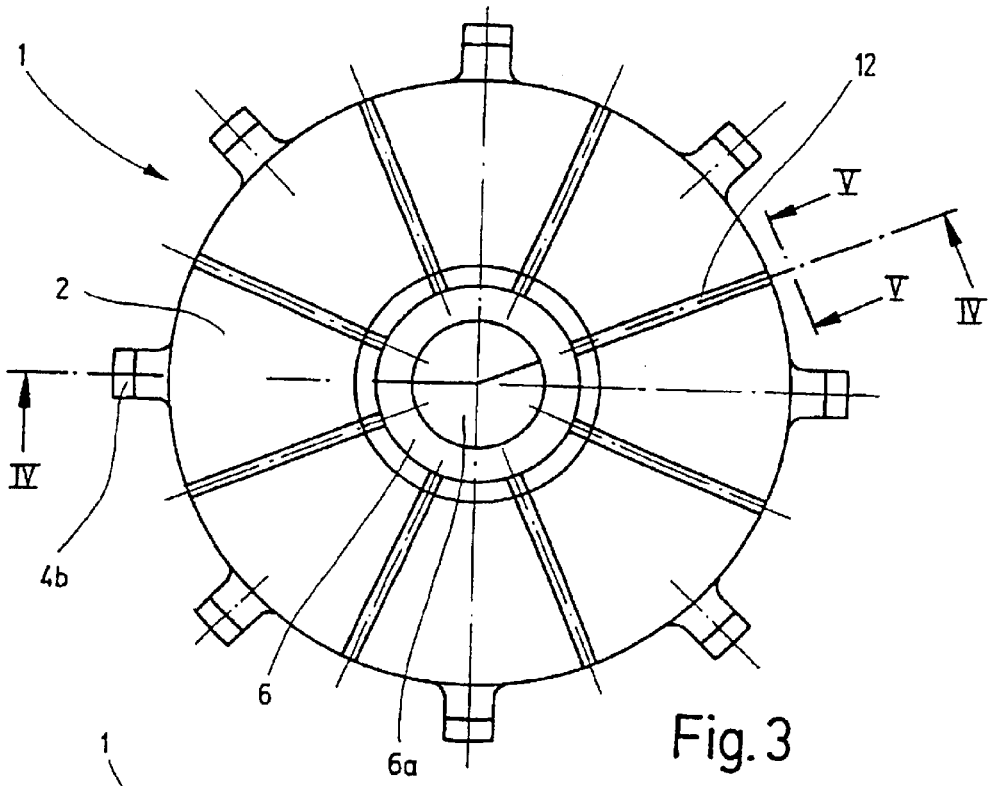
FIG. 3 is a bottom plan view of a segmented commutator according to the present invention.
Figure 4:
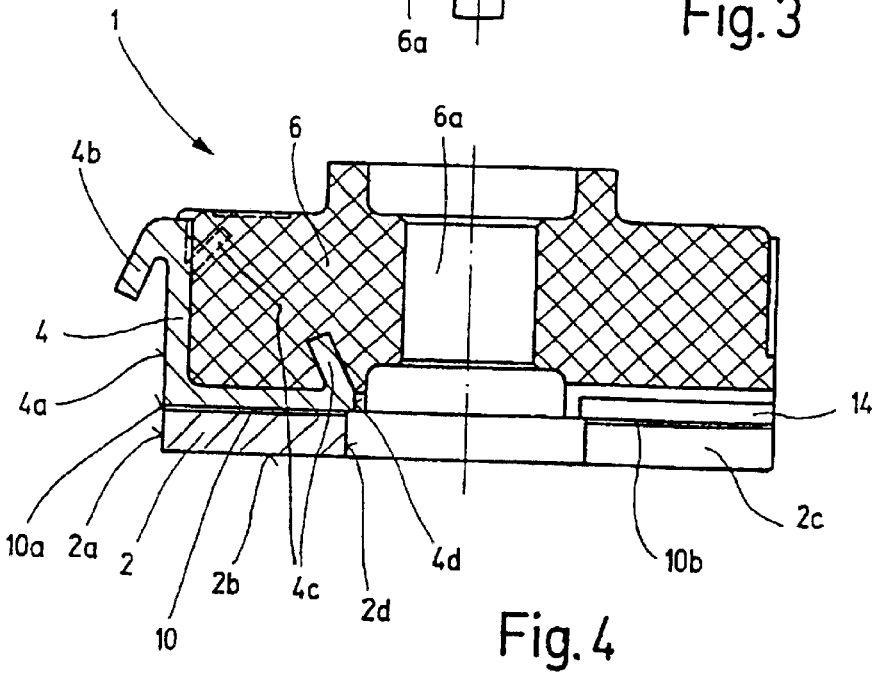
FIG. 4 is a side elevational view in section taken along line IV—IV through the commutator of FIG. 3.

FIG. 3 shows a plan view of the segmented annular disk of a commutator 1 produced using the process of the present invention. FIG. 4 shows section IV—IV through the commutator 1 of FIG. 3.

The annular disk is divided into eight annular segments 2. Likewise, the carrier body is divided into eight segment support parts 4. A hub 6 formed by extrusion is molded onto the segment support parts 4 of the carrier body and forms a central hole 6*a* for holding the shaft (not shown) of the rotor of a motor or generator. The segment support parts 4 on their outer peripheral surface 4*a* have a hook 4*b* for electrical connection of a rotor winding. In addition, the segment support parts 4 each have at least one anchor element 4*c* for fixed connection to the hub 6. The outer peripheral surface 4*a* corresponds in its diameter to the outer peripheral surface 2*a* of the annular segments 2 formed from the annular disk. The diameter of the inner peripheral surface 2*d* of the annular segments 2 corresponds essentially to the inner peripheral surface 4*d* of the segment support parts 4 or is slightly larger.

The joining layer and especially the solder layer 10 between the segment support part 4 and the annular segment 2 is, for example, 50 μm thick. When the annular disk and the carrier body are divided, cut slots 12 are formed which project into the area of the hub 6. The surfaces 14 of the essentially copper segment support parts 4 which are exposed by dividing the carrier body are covered with a coating which is resistant to a reactive environment. Preferably, the outer peripheral surface 4*a* and the hooks 4*b* of the segment support parts 4 are also coated. This enables better joining of the segment support parts to the rotor windings, especially easier contact bonding of the segment support parts over the outer peripheral surface 4*a* when welding the winding ends to the hooks 4*b*. Conversely, preferably neither the flat surfaces 2*b* which are used as the brush contact faces nor the surfaces 2*c* of the annular disk which have been exposed by dividing are coated. The joining layer 10 between the segment support parts 4 and the annular segments 2 is thus coated both on its surfaces 10*b* which are exposed by dividing and also on its inner and outer peripheral surface 10*a*.

Figure 5:
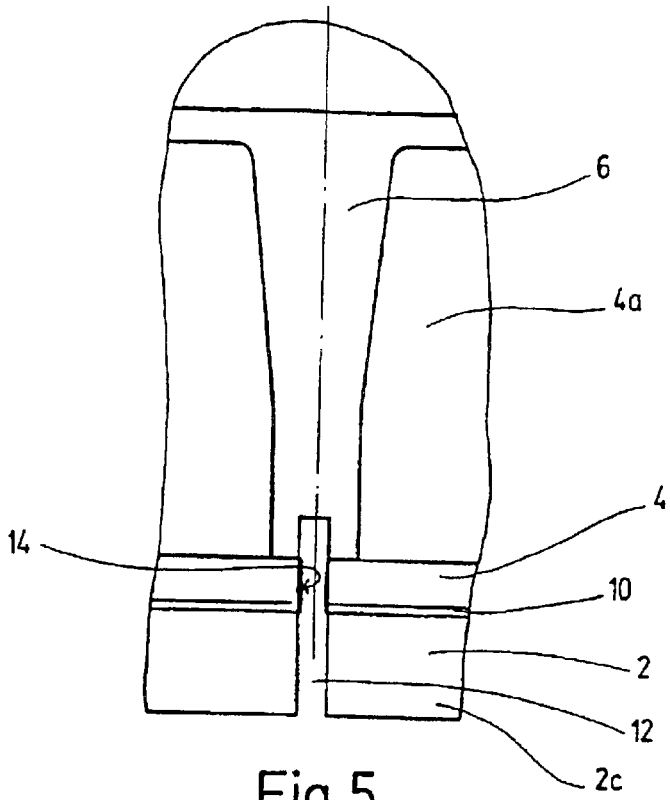
FIG. 5 is a partial side elevational view of the commutator of FIG. 3 taken from line V—V.

The cut slot shown enlarged in FIG. 5 compared to FIG. 4 was produced by abrasive grinding or sawing of the combination of the hub 6, the carrier body which forms the segment support parts 4, and the annular disk which forms the annular segments 2, in one process. The slot is typically a few tenths of a millimeter wide and a few millimeters deep. In particular, by coating using currentless deposition from a preferably tin-containing solution or suspension, a relatively resistant, thick and dense selective coating of the surfaces 14 of the segment support parts 4 exposed by division and optionally of the joining layer 10 can be achieved.

Figure 6:
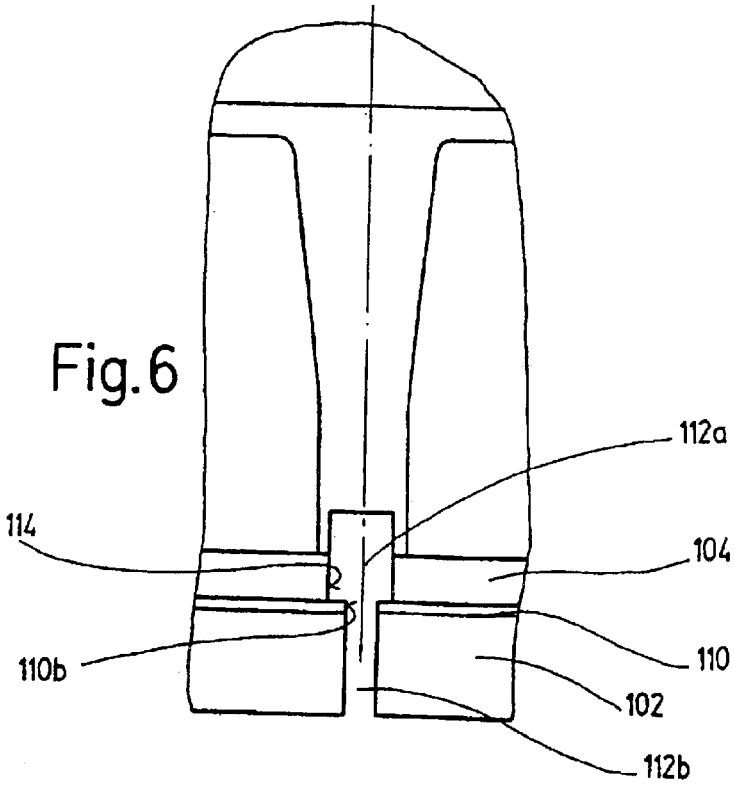
FIG. 6 is a partial side elevational view of a commutator produced using the production process of FIG. 2, which view corresponds to that of FIG. 5.

FIG. 6 shows a view of a commutator produced using the alternative production process from FIG. 2, a view which corresponds to FIG. 5. The carrier body was initially divided into segment support parts 104 with a first, wider slot 112*a*. The annular disk is then applied by means of the joining layer 110. Then the annular disk is divided into annular segments 102 by a second, narrower slot 112*b* aligned with the first slot. The coating (not shown) of the surfaces 114 of the segment support parts 104 exposed by dividing and optionally that of the exposed surface 110*b* of the joining layer 110 can take place either before or after application of the annular disk. Alternatively, the joining layer 110 does not end flush with the annular segments 102, but ends flush with the segment support parts 104.

While various embodiments have been chosen to illustrate the invention, it will be understood by those skilled in the art that various changes and modifications can be made therein without departing from the scope of the invention as defined in the appended claims.

What is claimed is:

1. A process for producing a flat commutator, comprising the steps of:

forming a metal carrier body with segment support parts;

forming a hub of electrically insulating material coupled to the carrier body;

joining an annular disk in an electrically conductive and strong mechanical manner to the carrier body on a side thereof opposite to the hub, the annular disk being resistive to a reactive environment;

dividing the carrier body to separate the segment support parts and to form exposed surfaces of the segment support parts by separation thereof;

dividing the annular disk into annular segments; and coating the exposed surfaces of the segment support parts formed by the dividing of the carrier body with an environment resistant coating by currentless deposition carried out from one of a solution and a suspension.

2. A process according to claim 1 wherein said annular disk contains carbon.

3. A process according to claim 1 wherein the carrier body is divided into segment support parts after joining the annular disk thereto.

4. A process according to claim 3 wherein the carrier body and the annular disk are divided in one step.

5. A process according to claim 4 wherein the carrier disk and the annular disk are cut in combination by one of abrasive cutting and sawing.

6. A process according to claim 1 wherein only the exposed surfaces of the segment support parts are selectively coated.

7. A process according to claim 1 wherein the coating is tin, silver or chromium.

8. A process according to claim 1 wherein the coating forms a layer having a thickness between 0.1 and 10 μm.

* * * * *